US009027310B2

(12) United States Patent
Russell et al.

(10) Patent No.: US 9,027,310 B2
(45) Date of Patent: May 12, 2015

(54) FILL BEHIND ZIPPER AND FILL THROUGH THE FLANGE ZIPPER

(75) Inventors: Glyn Russell, New City, NY (US); Charles Greco, Bardonia, NY (US); Lars Wihlborg, Stratford, CT (US); Robert J. Coulton, West Milford, NJ (US); David Anzini, Middletown, NY (US); Brian Ehrhardt, Orangeburg, NY (US); Francis Olajide, Jr., Bronx, NY (US); Eric Plourde, Frankfort, IL (US); David Pritchard, Morris, IL (US)

(73) Assignee: Illinois Tool Works Inc., Glenview, IL (US)

( * ) Notice: Subject to any disclaimer, the term of this patent is extended or adjusted under 35 U.S.C. 154(b) by 605 days.

(21) Appl. No.: 13/397,097

(22) Filed: Feb. 15, 2012

(65) Prior Publication Data

US 2013/0047553 A1 Feb. 28, 2013

Related U.S. Application Data

(60) Provisional application No. 61/444,208, filed on Feb. 18, 2011, provisional application No. 61/515,077, filed on Aug. 4, 2011.

(51) Int. Cl.

| | |
|---|---|
| ***B65B 61/18*** | (2006.01) |
| ***B65B 7/01*** | (2006.01) |
| ***B65B 7/02*** | (2006.01) |

(52) U.S. Cl.
CPC ..... *B65B 61/188* (2013.01); *Y10S 493/927* (2013.01)

(58) Field of Classification Search
CPC .... B65B 61/18; B65B 61/184; B65B 61/188; B65B 7/02; B65B 7/01
USPC ..... 53/412, 468, 469, 492, 133.4, 139.2, 53/284.7, 381.1, 381.2; 493/212–214, 493/927; 383/63, 64, 66
See application file for complete search history.

(56) References Cited

U.S. PATENT DOCUMENTS

| | | | | |
|---|---|---|---|---|
| 6,327,754 | B1 * | 12/2001 | Belmont et al. | 24/400 |
| RE40,284 | E * | 5/2008 | Thomas et al. | 53/412 |
| 7,621,105 | B2 | 11/2009 | Anzini et al. | |
| 7,963,007 | B2 | 6/2011 | Anzini et al. | |
| 2006/0185325 | A1 * | 8/2006 | Buchman et al. | 53/412 |
| 2007/0127850 | A1 * | 6/2007 | Buchman | 383/5 |
| 2008/0047228 | A1 | 2/2008 | Anzini et al. | |

* cited by examiner

*Primary Examiner* — Thanh Truong
*Assistant Examiner* — Praachi M Pathak
(74) *Attorney, Agent, or Firm* — McCarter & English, LLP

(57) ABSTRACT

The method and apparatus relates to providing a slit, perforation, line of weakness or similar structure in a flange of a zipper for a reclosable package or bag, including a high-capacity zipper. The slit, perforation, line of weakness or similar structure provides an opening for filling the reclosable package or bag without the need to separate the zipper profiles from each other. After filling, the opening is sealed and the cosmetic appearance of the reclosable package or bag is maintained.

16 Claims, 8 Drawing Sheets

FILL BEHIND ZIPPER AND FILL THROUGH THE FLANGE ZIPPER

This application claims priority under 35 U.S.C. §119(e) of provisional application Ser. No. 61/444,208 filed Feb. 18, 2011, and provisional application Ser. No. 61/515,077 filed on Aug. 4, 2011, the contents of which are hereby incorporated by reference.

BACKGROUND OF THE DISCLOSURE

1. Field of the Disclosure

The present disclosure relates to reclosable packages or bags that can be filled through the top of the package. The present disclosure further relates to the use of a perforated line or other line of weakness in a large capacity or high burst zipper in order to facilitate a fill-behind-the-zipper operation.

2. Description of the Prior Art

In the prior art, reclosable packages or bags have typically been filled two ways. The first is through the open zipper. However, this may not be practical in reclosable packages which use tamper evident structures, such as frangible panels, peel seals or high burst barriers between the zipper profiles and the package interior. Additionally, filling through the zipper may be problematic if a removable shroud over the top of the zipper is desired. A second method of filling through the top of the package is to leave the flange of one of the zipper halves unattached to one wall of the bag and to fill the bag between the zipper flange and the bag wall. However, this may be disadvantageous in that the final zipper-to-bag seal must be made in the location of the filling operation, which may be remote from the location where the bag was originally manufactured. Additionally, making the zipper-to-bag seal can be problematic in that the zipper and bag material are often made from incompatible materials, such as when a polyethylene zipper is mated to a multi-wall paper bag (MWPB) or to a woven polypropylene bag (wPP). In such an instance, the fill time is greatly increased due to required cooling times for hot melt glue systems. In other instances, long dwell times for heat or ultrasonic welding may be required.

Large reclosable packages and the methods of manufacture thereof are disclosed in commonly assigned U.S. Pat. No. 7,963,007, issued on Jun. 21, 2011, entitled "High Burst Zipper Assembly for Large Reclosable Packages"; U.S. Pat. No. 7,621,105, issued on Nov. 24, 2009 entitled "Method of Producing High Burst Zipper Assemblies for Large Reclosable Packages" and U.S. published application no. 2008/0047228, published on Feb. 28, 2008, entitled "Hot-Melt Adhesive Systems for Zipper Assemblies on Large Bag Constructions of Various Substrates". As stated above, while these large reclosable packages have been found to be suitable for their intended uses, further improvements may be sought in designing these packages with respect to filling these packages from the top. In particular, these references disclose that a separate strip of polyethylene material may be attached to the bag wall and one half of the zipper is left unconnected to the bag. Product is filled between the polyethylene strip and the zipper and then the zipper and strip are joined together to seal the bag. However, this method requires that an additional strip of polyethylene be supplied along with the zipper, adding cost and complicating bag construction.

SUMMARY AND OBJECTS OF THE DISCLOSURE

It is therefore an object of the present disclosure to allow top filling in large reclosable packages while minimizing or eliminating the disadvantages discussed above.

This and other objects are attained by a first embodiment of the method and apparatus wherein a flanged zipper is fed into a bag machine, one of the flanges is slit and overlapped, the slit and overlapped zipper is fed to a bag, product is filled through the slit, and the flange portions are moved back to an abutting overlap position and fused together.

A second embodiment of the method and apparatus substitutes a high-burst zipper and a pre-formed perforated line or other line of weakness for the slit of the first embodiment. This perforation is typically placed immediately below the wishbone configuration of a high burst zipper.

BRIEF DESCRIPTION OF THE DRAWINGS

Further objects and advantages of the invention will become apparent from the following description and from the accompanying drawing, wherein.

DETAILED DESCRIPTION OF THE PREFERRED EMBODIMENT

Figure 1:
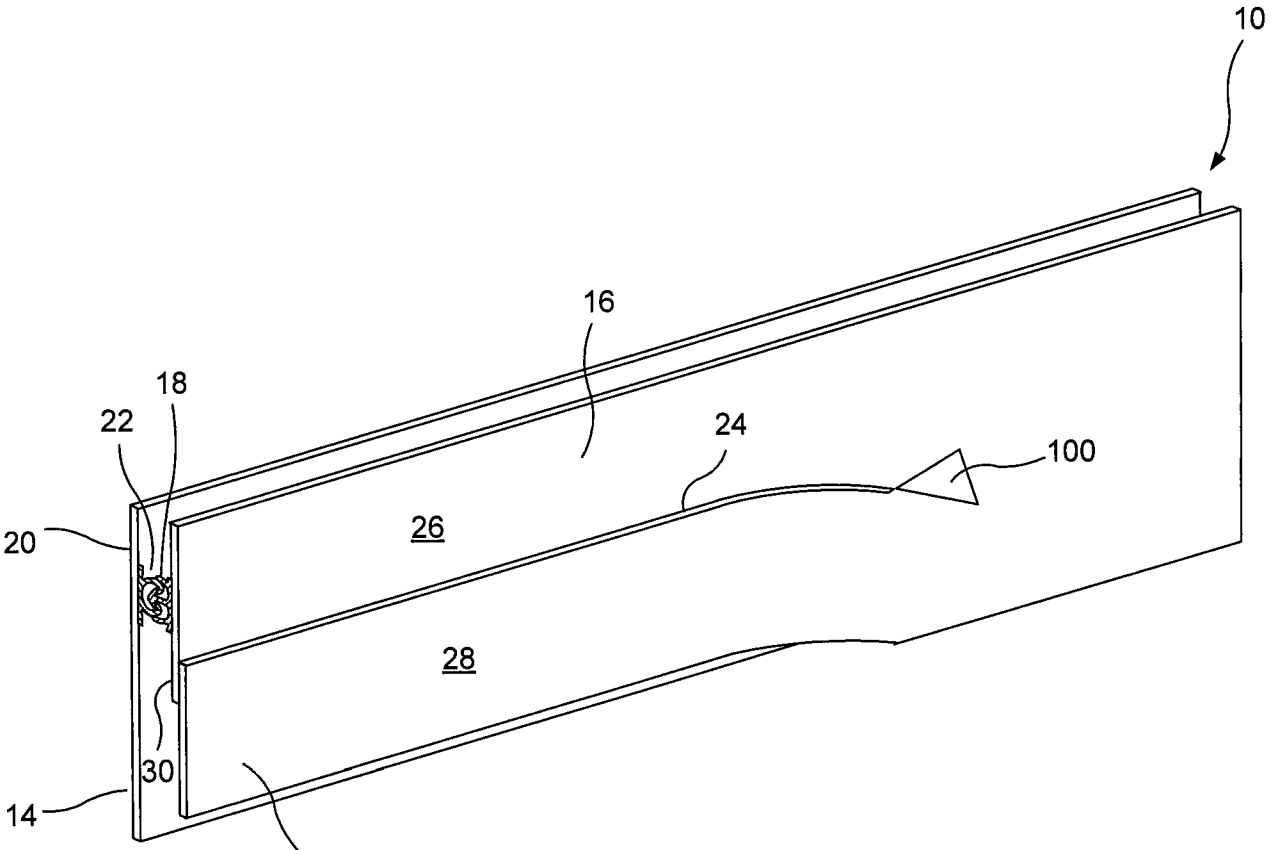
FIG. 1 is a schematic of a step of slitting the flange of a zipper for a reclosable package or bag further to a first embodiment of the disclosure.

Referring now to the drawings in detail wherein like numerals indicate like elements throughout the several views, one sees that FIG. 1 is a diagram of a zipper 10 which includes first profile 12 and second profile 14. Zipper 10 is typically made from a polymeric thermoplastic material. First profile 12 includes first flange 16 and first interlocking element 18 while second profile 14 includes second flange 20 and second interlocking element 22. As is known in the prior art, first interlocking element 18 is configured to interlock with second interlocking element 22. Likewise, as shown in FIG. 2, first and second flanges 16, 20 are configured to attach to the first and second walls 50, 52 of a reclosable package or bag 54, particularly, but not limited to, a large reclosable package or bag, including a high burst zipper, which may contain as much as fifty pounds of contents or more.

As shown in FIG. 1, slitter 100 cuts a slit 24 in first flange 16 so that first flange 16 includes upper portion 26 above the slit 24 and lower portion 28 below the slit 24. The slitter 100 may be stationary with the motion of the zipper 10 being fed into a bag machine (not shown) providing the relative movement between the slitter 100 and the zipper 10 and resulting in the linear character of slit 24. The lower portion 28 is then moved up to form an overlapping region 30 with respect to upper portion 26. Alternatively, the first flange 16 could be provided with a perforation or other line of weakness wherein the line of weakness is broken in lieu of using a slitter 100.

Figure 2:
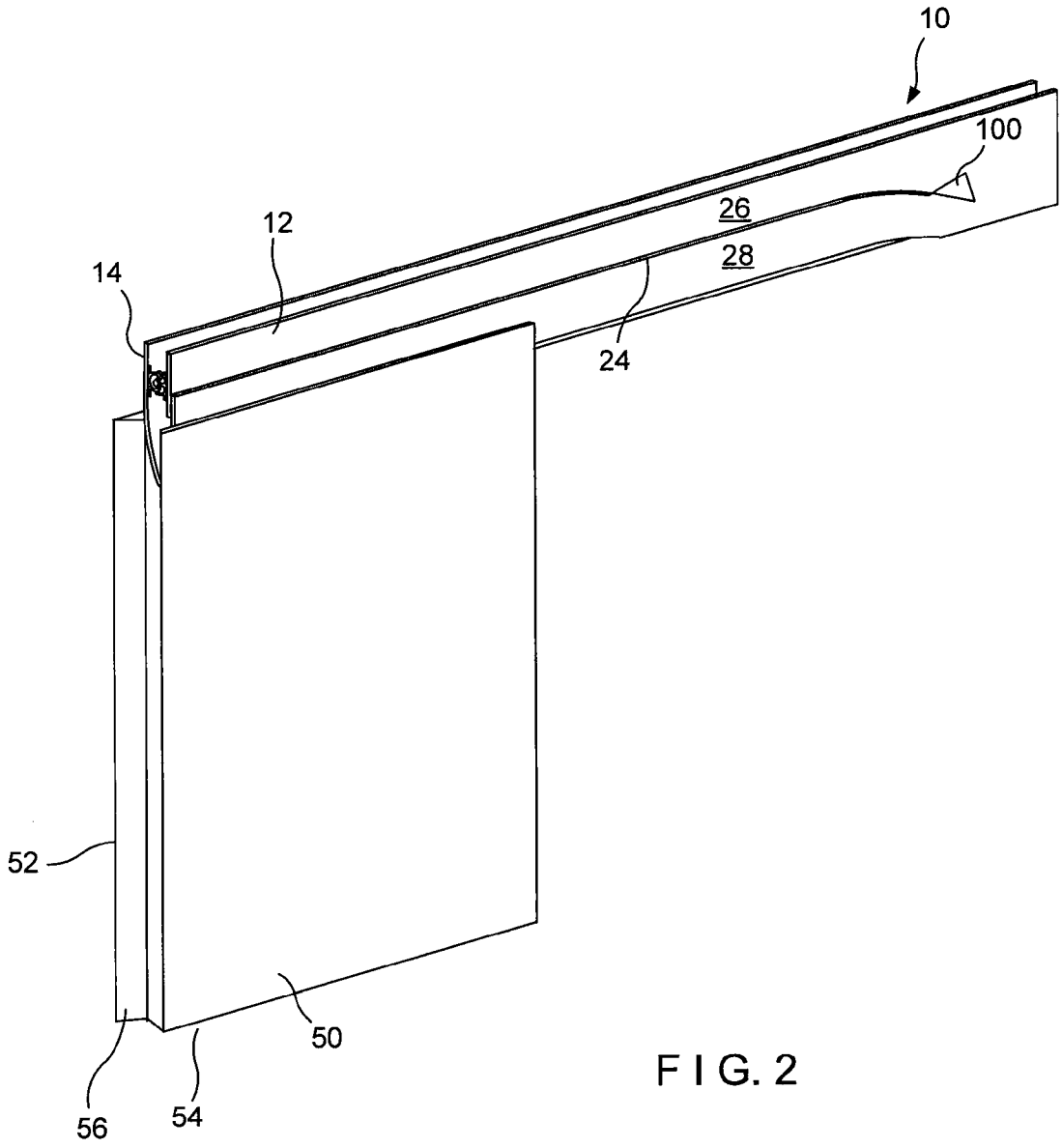
FIG. 2 is a schematic of a step of feeding the slit zipper to a pre-made package or bag further to a first embodiment of the disclosure.

As shown in FIG. 2, after the slit 24 and overlap have been formed, the zipper 10 is fed between first and second walls 50, 52 of a reclosable package or bag 54, which is shown with optional first gusset 56 formed between first and second walls 50, 52 (optionally with a similar gusset on the opposite side, obscured from view in FIG. 2).

Figure 3:
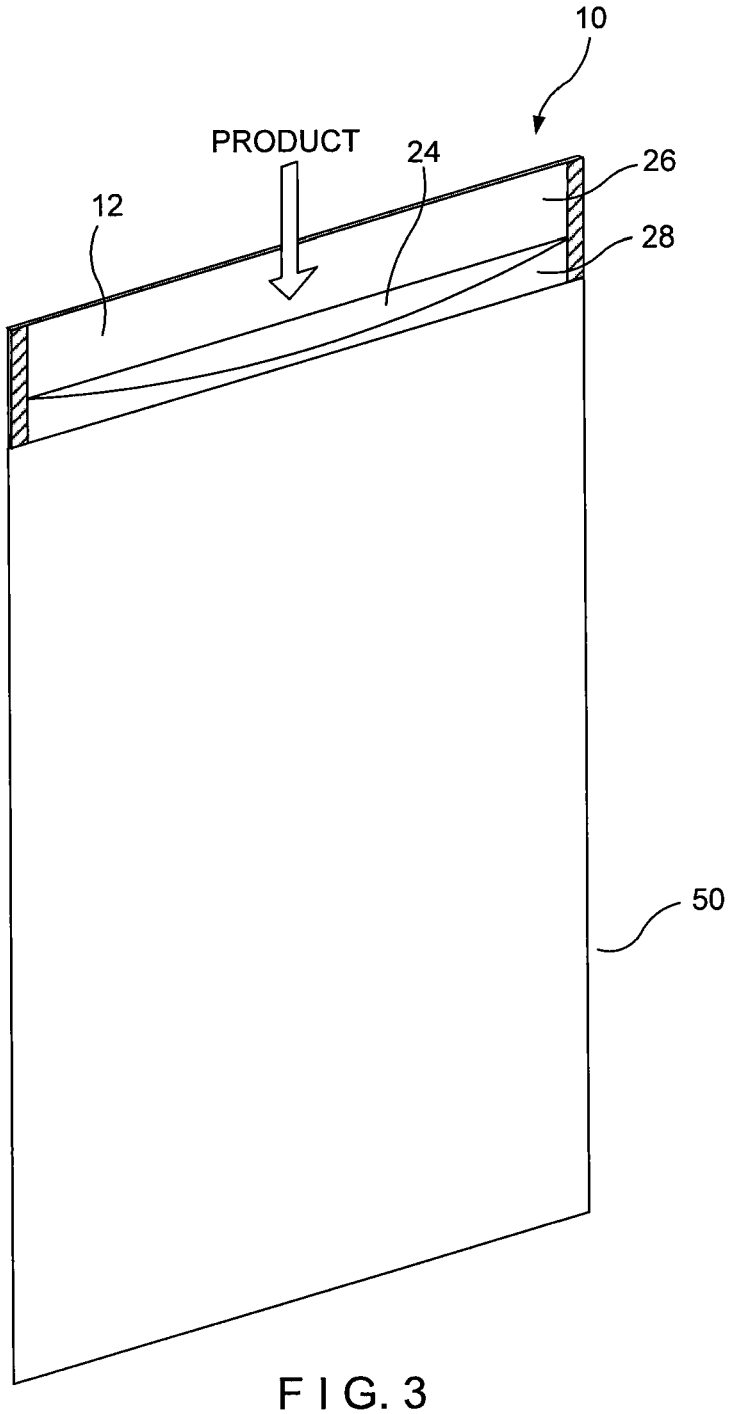
FIG. 3 is a schematic of a step of filling the bag with product through the slit in the zipper flange further to a first embodiment of the disclosure.
Figure 4:
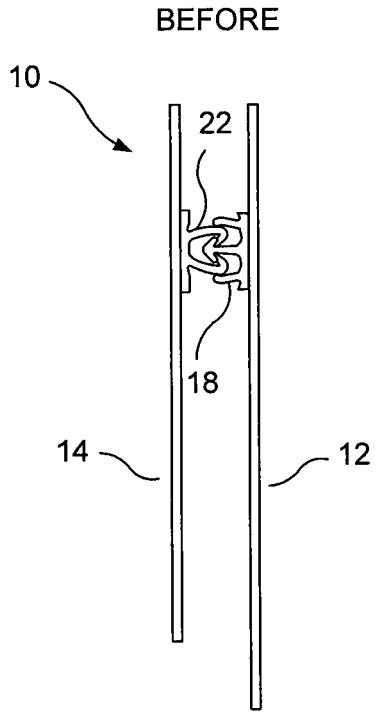
FIG. 4 is a cross-sectional view of the zipper profile prior to slitting further to a first embodiment of the disclosure.
Figure 5A:
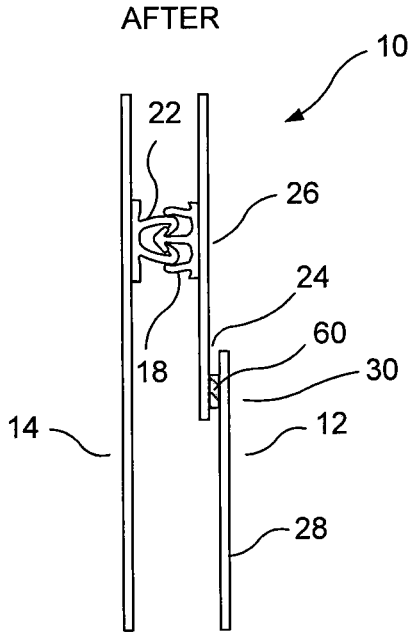
FIG. 5A is a cross-sectional view of the zipper profile after the steps of slitting, overlapping and sealing the zipper flange after the step of filling in accordance with a first embodiment of the disclosure.

First and second flanges 16, 20 of zipper 10 are secured to first and second walls of reclosable package or bag 54, typically by hot melt or other adhesives, or by heat or ultrasonic welding. Alternately, pre-slit, overlapped and end-sealed zipper 10 may straddle the reclosable package or bag 54 and be attached to the outer faces of walls 50, 52. The ends of zipper 10 are fused together and zipper 10 is cut to length thereby achieving the configuration of FIG. 3. Alternately, segments of zipper 10 may be fed to the package or bag 10. As further shown in FIG. 3, slit 24 is spread open and the product is inserted therein. The upper and lower portions 26, 28 of first flange 16 are then repositioned into abutting partially overlapping position and sealed, fused or otherwise connected or joined together thereby closing slit 24 as shown in FIG. 5A which illustrates hard seal 60 forming the connection between upper and lower portions 26, 28 of first flange 16. As shown by the comparison between FIGS. 4 (before the formation of slit 24) and 5A (after the formation of slit 24, the overlapping of the flanges, the filling of the product and the fusing or sealing of upper and lower portions of first flange 16), the first flange 16 may initially be supplied longer than second flange 20 so that the first and second flanges 16, 20 achieve an equal length after the above steps have been completed.

Figure 5B:
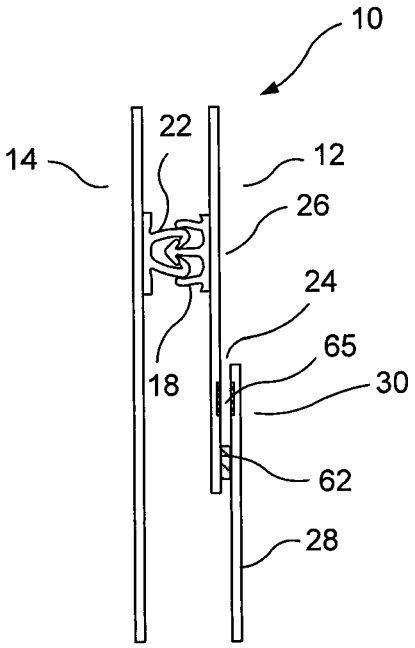
FIGS. 5B and 5C are cross-sectional views of an alternative embodiment of the present disclosure.
Figure 5C:
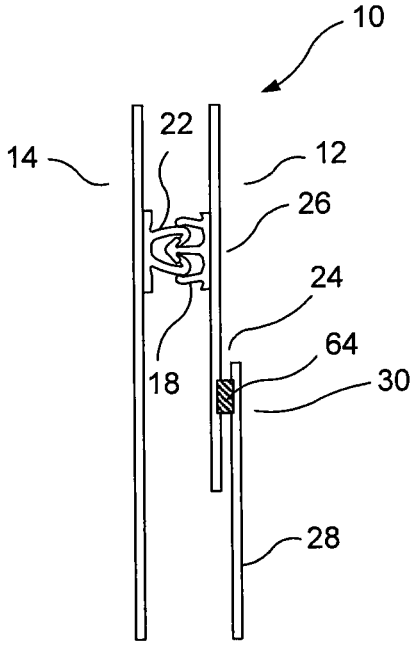

FIGS. 5B and 5C illustrate an alternative method wherein the upper and lower portions 26, 28 of first flange 16 are supplied in overlapping position, but are joined by a peelable seal 62 (using peelable material or a tack seal). In these alternate embodiments, the zipper 10 is attached to reclosable package or bag 54 as described above, but the filling is accomplished by peeling apart the peel seal 62 thereby separating upper and lower portions 26, 28 of first flange 16 and creating an opening through which product may be filled. After the reclosable package or bag 54 is filled, the upper and lower portions 26, 28 of first flange 16 are joined together again by forming a hard seal 64 away from the peelable seal 62. The positioning of additional sealant 65, if required, is shown in FIG. 5B and the resulting hard seal is formed in the same location as shown in FIG. 5C.

While lower portion 28 is shown to the exterior of the upper portion 26 of the first flange 16, this configuration could be reversed with the lower portion 28 to the interior of upper portion 26. Additionally, various easy-open or tamper-evident features, as well as a slider, could be incorporated into this design. Likewise, the fill method could use a one-time opening feature, with the reclosure feature removed or eliminated.

Figure 6:
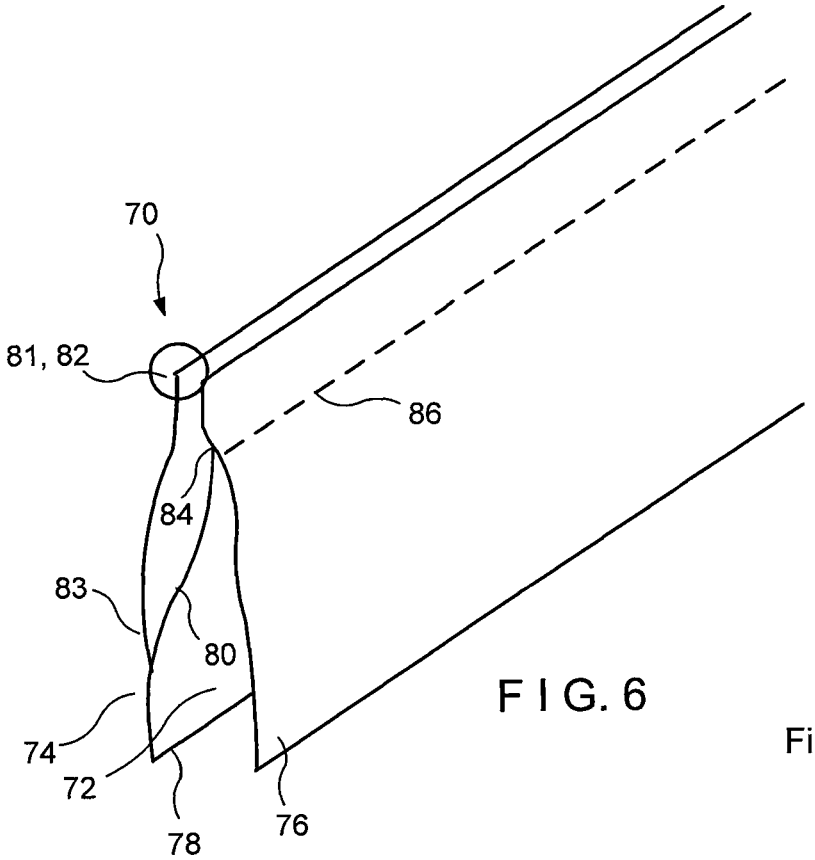
FIG. 6 is a perspective view of a zipper configuration with a perforation or similar line of weakness in the flange of a high burst zipper, further to a second embodiment of the disclosure.
Figure 8:
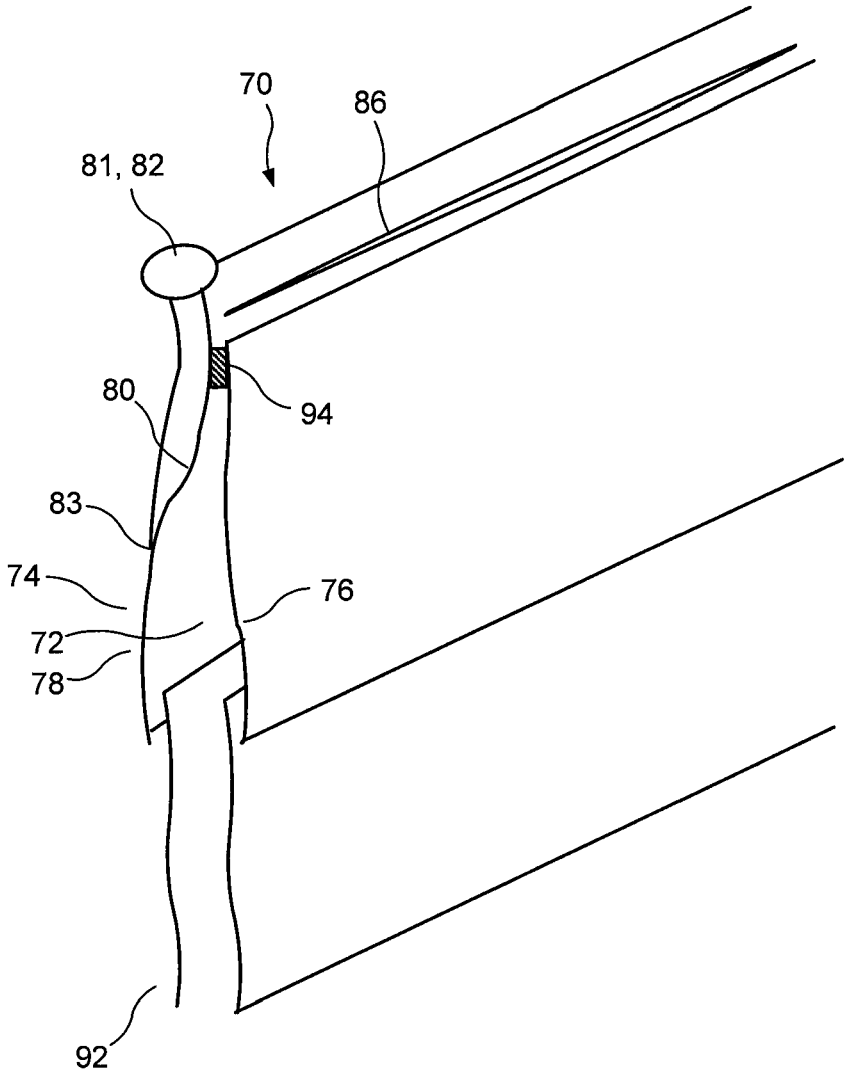
FIG. 8 is a perspective view of a high burst zipper configuration wherein the opening in the zipper flange has been sealed after the package or bag is filled with product, further to a second embodiment of the disclosure.
Figure 9:
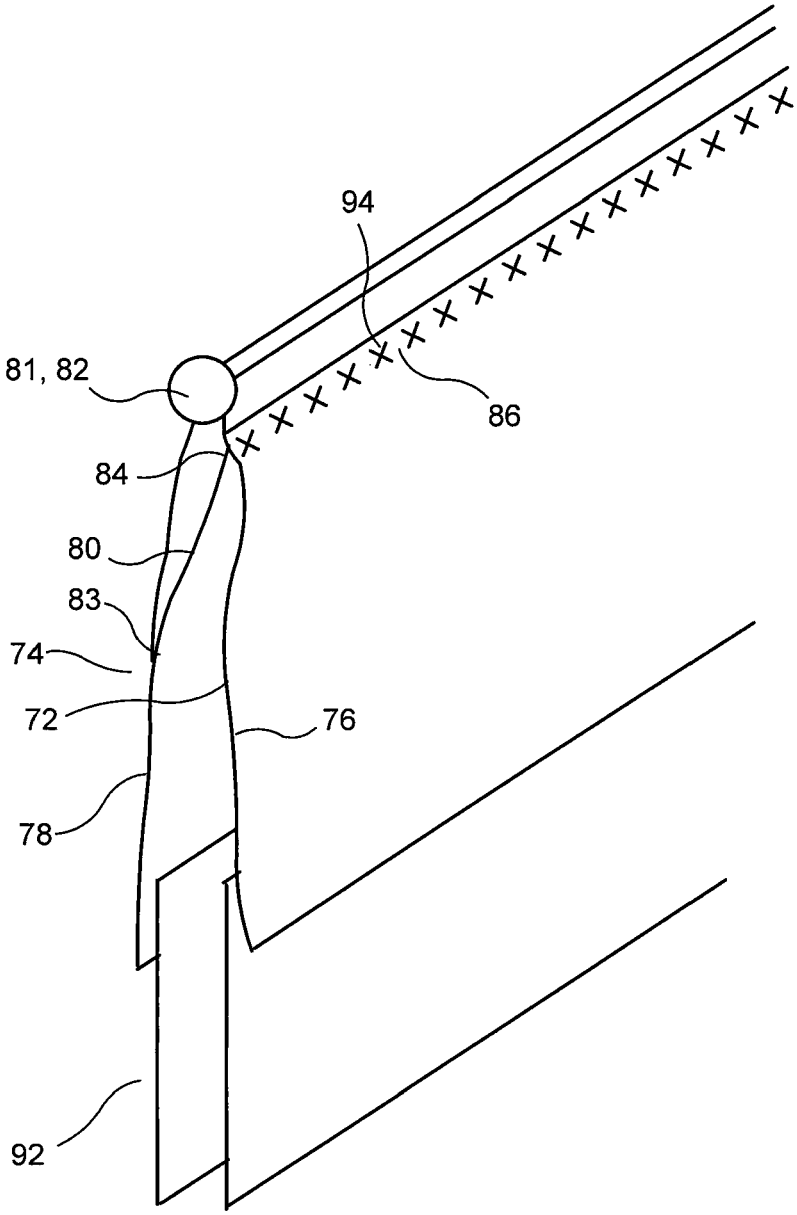
FIG. 9 is a perspective view of the high burst zipper configuration after sealing of the opening in the zipper flange, illustrating the re-creation of the high burst configuration.
Figure 10:
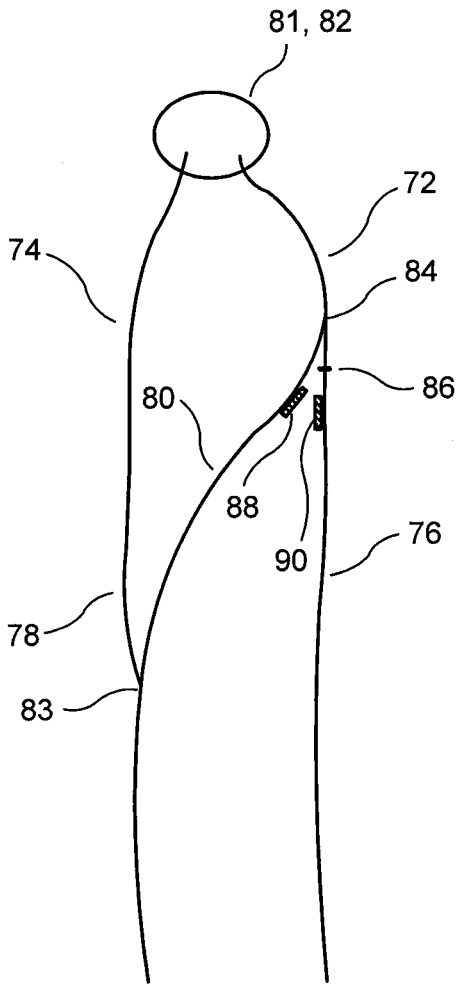
FIG. 10 is a cross-sectional view of a high burst zipper configuration, shown whereby a number of different zipper profiles may be used, further to a second embodiment of the disclosure.

A second embodiment of the disclosure is shown in FIGS. 6-10. In this embodiment, a high burst zipper 70 is used, such as is shown in FIG. 6. It should be noted that a high burst zipper 70 could be incorporated into any of the disclosed embodiments. The high burst zipper includes first and second profiles 72, 74 with respective first and second flanges 76, 78 and first and second interlocking elements 81, 82. Additionally, the high-capacity characteristics of the zipper 70 are enhanced by the internal segment 80 which joins first flange 76 to second flange 78. Segment 80 may be integrally extruded with first flange 76. As described in the above-identified U.S. Pat. Nos. 7,621,105 and 7,963,007 and U.S. published application no. 2008/0047228, the lower end of internal segment 80 is joined to second flange 78 by a peel seal 83 and the upper end of internal segment 80 is joined, fastened or secured at a joinder point to first flange 76 by a hard seal 84. Additionally, it is envisioned that the first and second interlocking elements 81, 82 can be implemented with a broad range of designs or configurations. A perforation 86 or other line of weakness is provided in first flange 76 immediately below the hard seal 84. Additionally, as shown in FIG. 10, a first hard seal coextrusion 88 is provided on internal segment 80 immediately below hard seal 84 and a second hard seal coextrusion 90 is provided on the interior of first flange 76 immediately below hard seal 84, so that first and second hard seal coextrusions 88, 90 are facing each other.

Figure 7:
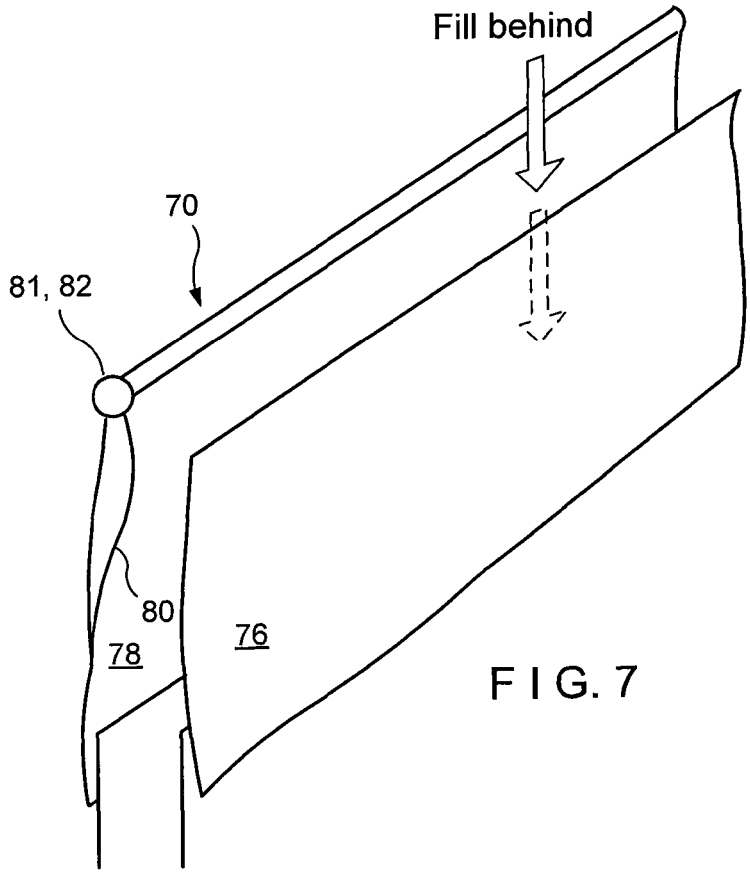
FIG. 7 is a perspective view of a high burst zipper configuration attached to walls of a package or bag, the zipper configuration shown with the perforation or similar line of weakness open for filling of the package or bag with product, further to a second embodiment of the disclosure.

With this second embodiment, perforation or other line of weakness 86 (which may include an opening which is temporarily closed by a fine peel seal) is opened as shown in FIG. 7, typically by suction cups, a separating finger or similar apparatus, so as to create a filling port for the previously constructed package or bag 92 (similar to reclosable package or bag 54 of the first embodiment described above). After filling, as shown in FIGS. 8 and 9, seal 94 is formed in first flange 76 by the sealing together of first and second hard seal coextrusions 88, 90. This sealing is typically performed by a drag sealer (not shown) and provides or restores integrity to the zipper 70, thereby typically providing a zipper which is nearly cosmetically identical to other high burst zippers.

The typical advantages of the second embodiment of this disclosure include that the zipper can be spooled similarly to current zippers, filling can be performed without opening the interlocking profiles of the zipper, the high burst strength of the zipper is not affected, and many types of interlocking elements can be used.

Thus the several aforementioned objects and advantages are most effectively attained. Although preferred embodiments of the invention have been disclosed and described in detail herein, it should be understood that this invention is in no sense limited thereby and its scope is to be determined by that of the appended claims.

What is claimed is:

1. A method of manufacturing a package or bag, comprising the steps of:

supplying a length of zipper material, wherein the length of zipper material includes first and second interlocking profiles;

wherein the first interlocking profile includes a first flange and a first interlocking element;

wherein the second interlocking profile includes a second flange and a second interlocking element;

providing a slit on the first flange and separating the first flange into an upper portion and a lower portion;

attaching the length of zipper material to a package or bag;

filling the package or bag with contents through the slit; and sealing the slit.

2. The method of claim 1 wherein the step of sealing the slit includes a step of putting the upper portion and lower portion of the first flange into at least partially abutting overlapping positions.

3. The method of claim 2 wherein the step of sealing the slit further includes a step of joining the upper portion to the lower portion.

4. The method of claim 3 wherein the step of joining the upper portion to the lower portion includes fusing or sealing the upper and lower portions to each other.

5. The method of claim 4 wherein the first flange is initially supplied with a length longer than that of the second flange.

6. The method of claim 5 wherein after the step of joining, a length of the first flange is substantially equal to that of the second flange.

7. A method of manufacturing a package or bag, comprising the steps of:

supplying a length of zipper material, wherein the length of zipper material includes first and second interlocking profiles;

wherein the first interlocking profile includes a first flange and a first interlocking element;

wherein the second interlocking profile includes a second flange and a second interlocking element;

providing a slit on the first flange;

temporarily sealing the slit with a peel seal;

attaching the length of zipper material to a package or bag;

temporarily opening the slit by separating the peel seal;

filling the package or bag with contents through the slit; and sealing the slit.

8. The method of claim 7 wherein the step of providing a slit on the first flange separates the flange into an upper portion and a lower portion.

9. The method of claim 8 wherein the step of sealing the slit includes a step of putting the upper portion and lower portion of the first flange into at least partially abutting overlapping positions.

10. The method of claim 9 wherein the step of sealing the slit further includes a step of joining the upper portion to the lower portion.

11. The method of claim 10 wherein the step of joining the upper portion to the lower portion includes fusing or sealing the upper and lower portions to each other.

12. A method of manufacturing a package or bag, comprising the steps of:

supplying a length of zipper material, wherein the length of zipper material includes first and second interlocking profiles, wherein the first interlocking profile includes a first flange and a first interlocking element and wherein the second interlocking profile includes a second flange and a second interlocking element, wherein the length of zipper material further includes a segment with a first end and a second end, the first end being attached to the first flange at a joinder point and the second end being attached to the second flange by a peel seal;

providing a line of weakness on the first flange proximate to the joinder point;

attaching the length of zipper material to a package or bag;

breaking the line of weakness thereby forming an opening;

filling the package or bag with contents through the opening; and sealing the opening.

13. The method of claim 12 further including a step of providing at least one hard seal extrusion proximate to the line of weakness.

14. The method of claim 12 wherein the line of weakness is below the joinder point.

15. The method of claim 12 wherein the line of weakness is a perforation.

16. A method of manufacturing a package or bag, comprising the steps of:

supplying a length of zipper material, wherein the length of zipper material includes first and second elements, wherein at least portions of the first and second elements are interlockable with each other;

providing a line of weakness on the first element;

attaching the length of zipper material to a package or bag;

breaking the line of weakness thereby creating an opening;

filling the package or bag with contents through the opening; and sealing the opening.

* * * * *